US007278714B2

(12) United States Patent
Kaneko

(10) Patent No.: US 7,278,714 B2
(45) Date of Patent: Oct. 9, 2007

(54) LIQUID EJECTION HEAD AND METHOD OF MANUFACTURING SOLUTION GUIDE

(75) Inventor: Yasuhisa Kaneko, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 236 days.

(21) Appl. No.: 11/154,477

(22) Filed: Jun. 17, 2005

(65) Prior Publication Data

US 2005/0280688 A1 Dec. 22, 2005

(30) Foreign Application Priority Data

Jun. 17, 2004 (JP) ..... 2004-179520

(51) Int. Cl.
*B41J 2/06* (2006.01)

(52) U.S. Cl. ..... 347/55

(58) Field of Classification Search ..... 347/55, 347/9, 54, 101, 77

See application file for complete search history.

(56) References Cited

U.S. PATENT DOCUMENTS 5,619,234 A 4/1997 Nagato et al.
5,835,113 A 11/1998 Hirahara et al.
6,158,844 A 12/2000 Murakami et al.
6,919,169 B2 * 7/2005 Tsuruma ..... 430/320
2002/0122099 A1 9/2002 Furukawa
2004/0183879 A1 * 9/2004 Nakazawa ..... 347/101
2005/0024439 A1 * 2/2005 Fukunaga et al. ..... 347/55

FOREIGN PATENT DOCUMENTS

JP 8-149253 A 6/1996
JP 10-76664 A 3/1998
JP 10-230608 A 9/1998
JP 2003-175612 A 6/2003

* cited by examiner

*Primary Examiner*—K. Feggins
(74) *Attorney, Agent, or Firm*—Sughrue Mion Pllc.

(57) ABSTRACT

Provided is a liquid ejection head for electrostatic ink jet capable of ejecting ink droplets at a low voltage and at high speed. The liquid ejection head includes: an ejection substrate in which ejection openings are formed; ejection electrodes that respectively correspond to the ejection openings; and solution guides that pass through the ejection openings and protrude from the ejection substrate. The solution guides are each a member whose at least tip end portion is made of a composite material containing a resin material and particles of a high-dielectric material dispersed in the resin material.

4 Claims, 4 Drawing Sheets

LIQUID EJECTION HEAD AND METHOD OF MANUFACTURING SOLUTION GUIDE

This application claims priority on Japanese patent application No. 2004-179520, the entire contents of which are hereby incorporated by reference.

BACKGROUND OF THE INVENTION

The present invention relates to an electrostatic liquid ejection head, which ejects droplets by exerting electrostatic forces on a solution in which charged particles are dispersed, and a method of manufacturing solution guides of the liquid ejection head.

As liquid ejection heads (hereinafter referred to as the "ejection heads") for ink jet that perform image recording (drawing) by ejecting ink droplets, an ejection head for so-called thermal ink jet printer that ejects ink droplets by means of expansive forces of air bubbles generated in ink through heating of the ink and an ejection head for so-called piezoelectric-type ink jet printer that ejects ink droplets by giving pressures to ink using piezoelectric elements are known.

In the case of the thermal ink jet head, however, the ink is partially heated to 300° C. or higher, so there is a problem that a material of the ink is limited. On the other hand, in the case of the piezoelectric-type ink jet head, there is a problem that a complicated structure is used and an increase in cost is inevitable.

As ink jet printer that solves the problems described above, electrostatic ink jet printer is known which uses ink containing charged colorant particles (fine particles), exerts electrostatic forces on the ink, and ejects ink droplets by means of the electrostatic forces.

An ejection head for the electrostatic ink jet printer includes: an insulative ejection substrate, in which many through holes (ejection openings) for ejecting ink droplets have been formed; and ejection electrodes that respectively correspond to the ejection openings, and ejects ink droplets by exerting electrostatic forces on ink through application of predetermined voltages to the ejection electrodes. More specifically, with the construction, the ejection head ejects the ink droplets by controlling on/off of the voltage application to the ejection electrodes (modulation-driving the ejection electrodes) in accordance with image data, thereby recording an image corresponding to the image data on a recording medium.

An example of such an ejection head for the electrostatic ink jet printer is disclosed in JP 10-230608 A. As conceptually shown in FIG. 4, the ejection head 200 includes a support substrate 202, an ink guide 204, an ejection substrate 206, an ejection electrode 208, a bias voltage supply 212, and a signal voltage supply 214.

In the ejection head 200, the support substrate 202 and the ejection substrate 206 are each an insulative substrate and are arranged so as to be spaced apart from each other by a predetermined distance.

Many through holes (substrate through holes) that each serve as an ejection opening 218 for ejecting an ink droplet have been formed in the ejection substrate 206 and a gap between the support substrate 202 and the ejection substrate 206 is set as an ink flow path 216 that supplies ink Q to the ejection opening 218. In addition, the ring-shaped ejection electrode 208 is provided for an upper surface (ink-droplet-R-ejection-side surface) of the ejection substrate 206 so as to surround the ejection opening 218. The bias voltage supply 212 and the drive voltage supply 214 that is a pulse voltage supply are connected to the ejection electrode 208 and the drive voltage supply 214 is grounded through the bias voltage supplies 212.

On the other hand, on the support substrate 202, the ink guide 204 is provided so as to correspond to the ejection opening 218 and protrude from the ejection substrate 206 while passing through the ejection opening 218. Also, an ink guide groove 220 for supplying the ink Q to a tip end portion 204*a* of the ink guide 204 is formed by notching the tip end portion 204*a* by a predetermined width.

In an (ink jet) recording apparatus using the ejection head 200 disclosed in JP 10-230608 A, at the time of image recording, a recording medium P is supported by a counter electrode 210.

The counter electrode 210 functions not only as a counter electrode for the ejection electrode 208 but also as a platen supporting the recording medium P at the time of the image recording and is arranged so as to face the upper surface of the ejection substrate 206 in FIG. 4 and be spaced apart from the tip end portion 204*a* of the ink guide 204 by a predetermined distance.

In the ejection head 200, at the time of the image recording, by an ink circulation mechanism (not-shown), the ink Q containing the charged colorant particles is caused to flow in the ink flow path 216 in a direction, for instance, from the right side to the left side in the drawing. Note that the colorant particles of the ink Q are charged to the same polarity as the voltage applied to the ejection electrode 208.

Also, the recording medium P is supported by the counter electrode 210 and faces the ejection substrate 206.

Further, a DC voltage of 1.5 kV, for example, is constantly applied from the bias voltage supply 212 to the ejection electrode 208 as a bias voltage.

As a result of the ink Q circulation and the bias voltage application, by the action of surface tension of the ink Q, a capillary phenomenon, an electrostatic force due to the bias voltage, and the like, the ink Q is supplied from the ink guide groove 220 to the tip end portion 204*a* of the ink guide 204, a meniscus of the ink Q is formed at the ejection opening 218, the colorant particles move to the vicinity of the ejection opening 218 (migration due to an electrostatic force), and the ink Q is concentrated in the ejection portion 218 and the tip end portion 204*a*.

Under this condition, when the drive voltage supply 214 applies a pulse-shaped drive voltage of 500 V, for example, corresponding to image data (drive signal) to the ejection electrode 208, the drive voltage is superimposed on the bias voltage, and the supply and concentration of the ink Q to and in the tip end portion 204*a* are promoted. Following this, at a point in time when a movement force of the ink Q and the colorant particles to the tip end portion 204*a* and an attraction force from the counter electrode 210 has exceeded the surface tension of the ink Q, a droplet (ink droplet R) of the ink Q in which the colorant particles have been concentrated is ejected.

The ejected ink droplet R flies due to momentum at the time of the ejection and the attraction force from the counter electrode 210, impinges on the recording medium P, and forms an image.

In the manner described above, in the electrostatic ejection head., the ink droplet R is ejected by controlling a balance between the surface tension of the ink Q and the electrostatic force exerted on the ink Q.

Consequently, in order to perform the ink droplet ejection at a low drive voltage, at high speed (high recording (ejection) frequency), and with stability, the ink guide provided for each ejection opening is important and is required to realize meniscus stability with which the ink is suitably guided and the meniscus of the ink at the ejection opening is appropriately stabilized, an electric field concentration force with which the electrostatic force is favorably concentrated, and the like.

In order to realize such characteristics, in the electrostatic ejection head, various thoughts are put into the ink guide.

For instance, in the ejection head disclosed in JP 10-230608 A, as described above, by forming the ink guide groove 220 through the notching of the tip end portion 204*a* of the ink guide 204 by the predetermined width, the supplyability of the ink Q to the tip end portion 204*a* of the ink guide 204 is made more favorable.

Also, JP 10-76664 A discloses an electrostatic ejection head in which the electric field concentration force by the ink guide is increased by forming a second electrode for a surface of the ink guide (protrusion plate). Further, JP 08-149253 A discloses an electrostatic ejection head in which the electric field concentration force by the ink guide is increased by covering the surface of the ink guide (conical protrusion) with the ejection electrode.

SUMMARY OF THE INVENTION

In order to obtain such an ink guide achieving favorable meniscus stability and electric field concentration force, it is preferable that the ink guide be formed with favorable formability and with high precision so that it is capable of guiding ink with reliability and have a high dielectric constant so that it is capable of concentrating an electric field on itself.

In ordinary cases, in order to obtain an ink guide having a favorable dielectric constant, the ink guide is molded from a ceramics material, such as $ZrO_2$ or $Al_2O_3$, which has a high dielectric constant. However, the ceramics is low in moldability and workability and is also hard and fragile. In addition, in recent years, as a result of an increase in recording resolution, it is required to mold/work the ink guide in a finer manner. Therefore, it is difficult to mold the ink guide having the ink guide groove 220 described in JP 10-230608 A or the like from the ceramics material with high precision. In addition, there is also a problem that the molding of the ceramics requires a high temperature of around 1000° C.

On the other hand, when the ink guide is forming using a resin material, it is possible to secure favorable moldability and workability and realize an ink guide formed finely and highly accurately and having excellent ink guidability. However, the dielectric constant of such a resin-made ink guide is low and it is difficult to obtain an ink guide achieving a superior electric field concentration force.

Aside from above, as disclosed in JP 10-76664 A and JP 08-149253 A, there is also a method of increasing the electric field concentration force by forming an electrode for a surface of an ink guide. With this method, however, ejection head productivity is lowered. In addition, in this case, electric field interferences between adjacent ejection openings (channels) are easy to occur, so there is also a problem that it is difficult to increase the density of the ejection openings and form a two-dimensional head (head in which the ejection openings are two-dimensionally arranged).

An object of the present invention is to solve the problems of the conventional techniques described above. Therefore there is provided: an electrostatic liquid ejection head, which is capable of ejecting ink droplets for flying through low-voltage driving, at high speed, and with stability by including solution guides (ink guides) that are made of a material having a high dielectric constant and also having high formability and achieve excellent meniscus stability and electric field concentration force; and a method of manufacturing the solution guides used in the liquid ejection head.

In order to achieve the above-mentioned object, the present invention provides a liquid ejection head that ejects droplets of a solution in which charged particles are dispersed by exerting electrostatic forces on the solution, including: an insulative ejection substrate in which a plurality of through holes for the droplet ejection are formed; ejection electrodes that are each arranged in correspondence with each of the through holes and exert the electrostatic forces on the solution; and solution guides that pass through the through holes and protrude toward a droplet ejection side of the ejection substrate, in which the solution guides are each a member whose at least tip end portion is made of a composite material containing a resin material and particles of a high-dielectric material dispersed in the resin material.

In the liquid ejection head according to the present invention, it is preferable that the solution guides each have a shape that is gradually narrowed toward a tip end, that the solution guides be each a member whose at least tip end side with respect to a corresponding ejection electrode is made of the composite material, and that the resin material be any one of a silicon resin, an epoxy resin, an urethane resin, a polyimide resin, and a phenol resin, and the high-dielectric material be any one of PZT, PMN-PT, barium titanate, and strontium titanate.

Further, the present invention provides a method of manufacturing solution guides used in a liquid ejection head, the liquid ejection head having an insulative ejection substrate in which a plurality of through holes for droplet ejection are formed and solution guides that pass through the through holes and protrude toward a droplet ejection side of the ejection substrate, including: filling a composite material containing a resin material and particles of a high-dielectric material dispersed in the resin material that has not been cured into a mold having a plurality of concave portions corresponding to a shape of the solution guides; curing the composite material; removing redundant composite material; fixing solution guide base end portions made of the cured composite material to a support substrate made of a material that is the same as the resin material of the composite material; and removing the mold.

In the method according to the present invention, it is preferable that the liquid ejection head have ejection electrodes that are each arranged in correspondence with each of the through holes and exert the electrostatic forces on a solution in which charged particles are dispersed so as to eject droplets of the solution from the through holes, that the solution guides each have a shape that is gradually narrowed toward a tip end, and that the resin material be any one of a silicon resin, an epoxy resin, an urethane resin, a polyimide resin, and a phenol resin, and the high-dielectric material be any one of PZT, PMN-PT, barium titanate, and strontium titanate.

According to the present invention having the construction described above, it becomes possible to realize an electrostatic liquid ejection head including solution guides (ink guides) that have been worked finely and highly accurately, and also have a high dielectric constant, so that they are capable of suitably guiding ink and appropriately stabilizing meniscuses of the ink at ejection openings and achieve an excellent electric field concentration force.

Accordingly, with the liquid ejection head according to the present invention, in the electrostatic ink jet printer, it becomes possible to eject ink droplets for flying through low-voltage driving, at high speed (high recording (droplet ejection) frequency), and with stability.

DETAILED DESCRIPTION OF THE PREFERRED EMBODIMENT

Hereinafter, a liquid ejection head and a manufacturing method of a solution guide for this liquid ejection head according to the present invention will be described in detail based on a preferred embodiment illustrated in the accompanying drawings.

Figure 1:
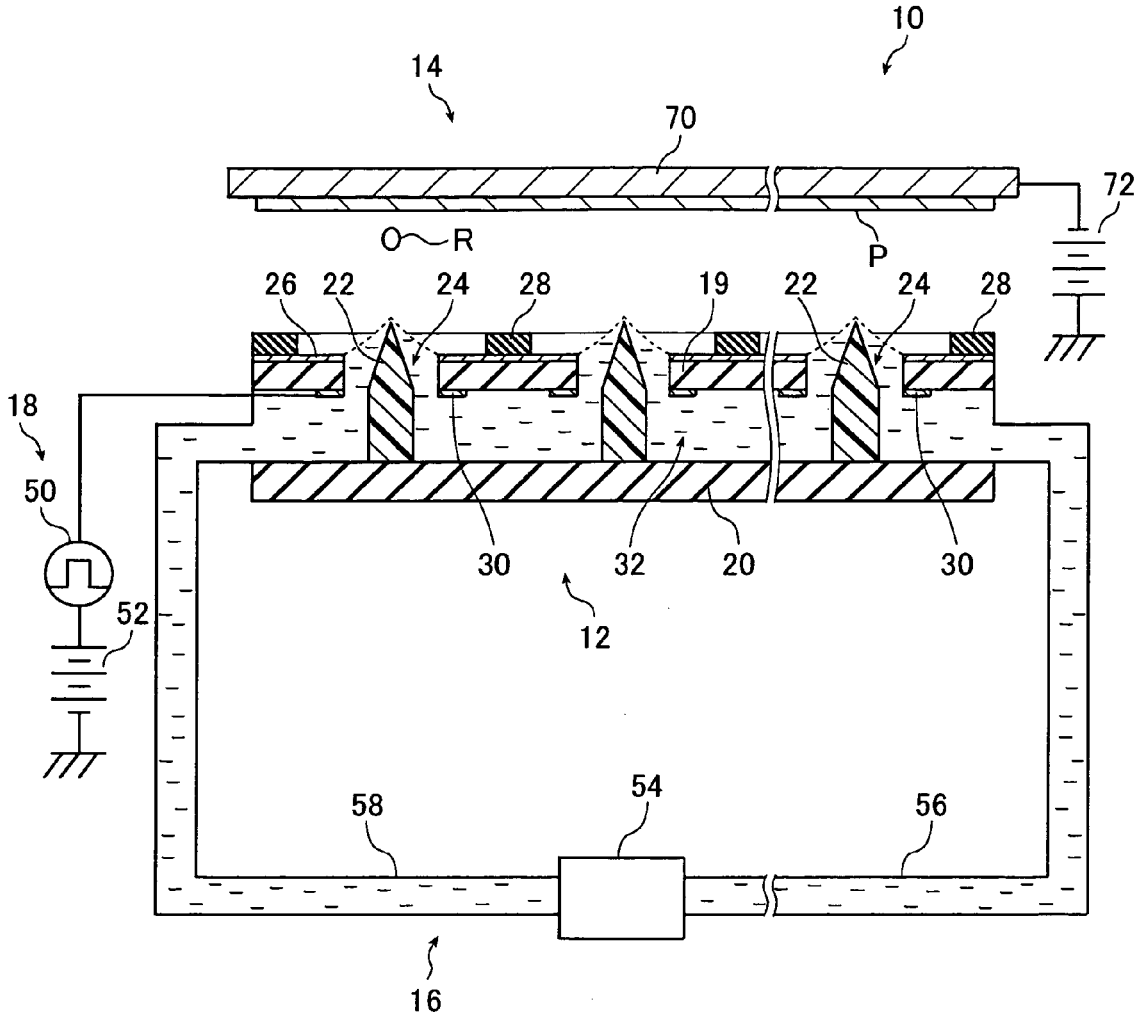
FIG. 1 is a conceptual diagram of an example of an ink jet recording apparatus using an example of the liquid ejection head according to the present invention.

FIG. 1 is a conceptual diagram of an example of an ink jet recording apparatus using an example of the electrostatic liquid ejection head according to the present invention.

An ink jet recording apparatus 10 (hereinafter referred to as the "recording apparatus 10") shown in FIG. 1 performs image recording (drawing) on a recording medium P by ejecting ink droplets R through electrostatic ink jet head and basically includes a liquid ejection head 12 (hereinafter referred to as the "ejection head 12") according to the present invention, a holding means 14 for holding the recording medium P, an ink circulation system 16, and a voltage application means 18.

In the recording apparatus 10 in the illustrated example, the ejection head 12 is, for instance, a so-called line head including a row (hereinafter referred to as the "nozzle row") of openings 24 for ejecting the ink droplets R that corresponds to the entire region on one side of the recording medium P.

In the recording apparatus 10, the recording medium P is held by the holding means 14 and the holding means 14 is moved (scan-transported) in a direction orthogonal to the nozzle row of the ejection head 12 under a state in which the recording medium P is positioned at a predetermined recording position so as to face the ejection head 12, thereby two-dimensionally scanning the entire surface of the recording medium P using the nozzle row. In synchronization with the scanning, modulation is performed in accordance with an image to be recorded and the ink droplets R are ejected from the ejection openings 24 of the ejection head 12, thereby recording the image on the recording medium P in an on-demand manner.

Also, at the time of the image recording, ink Q is circulated by the ink circulation system 16 through a predetermined circulation path including the ejection head 12 (ink flow path 32 to be described later) and is supplied to each ejection opening 24.

Figure 2:
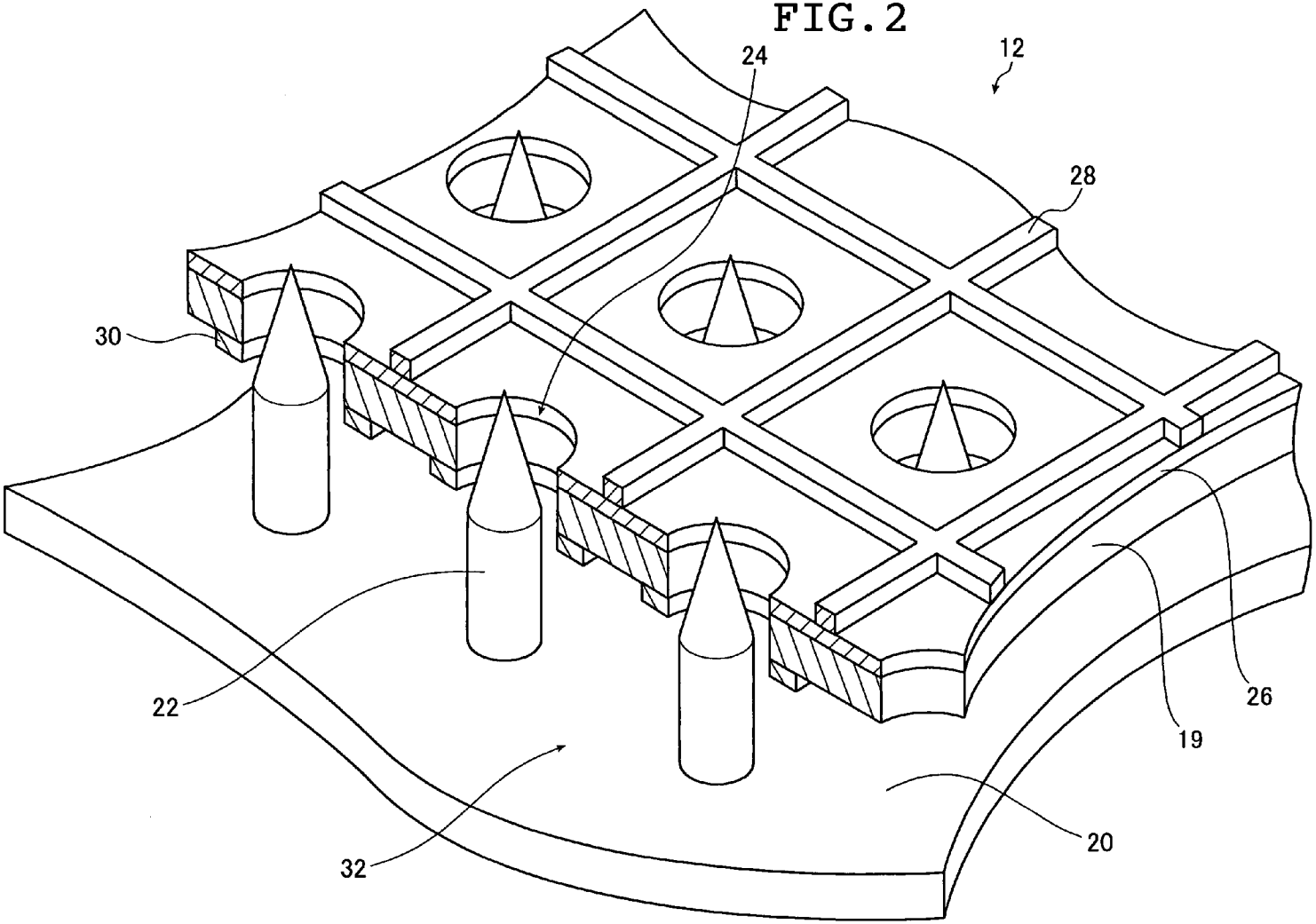
FIG. 2 is a schematic perspective view of the liquid ejection head shown in FIG. 1.

The ejection head 12 is an electrostatic liquid ejection head that ejects the ink Q (ink droplets R) by electrostatic forces and basically includes an ejection substrate 19, a support substrate 20, and ink guides 22 that are each a characteristic portion of the present invention, as shown in FIGS. 1 and 2.

The ejection substrate 19 is a substrate made of a ceramics material, such as $Al_2O_3$ or $ZrO_2$, or an insulative material, such as polyimide, and many ejection openings 24 for ejecting the ink droplets R of the ink Q have been established so as to pass through the ejection substrate 19.

In a preferable example shown in the schematic diagram in FIG. 2 in which higher-resolution and higher-speed image recording is possible, the ejection head 12 includes the ejection openings 24 arranged in a two-dimensional lattice manner.

It should be noted here that the liquid ejection head according to the present invention is not limited to the construction in the illustrated example in which the ejection openings 24 are arranged in a lattice manner and may have a construction in which adjacent nozzle rows are displaced from each other by a half pitch and the ejection openings are arranged in a staggered lattice manner, for instance. Alternatively, the liquid ejection head according to the present invention may have a construction in which the ejection openings are not two-dimensionally arranged but only one nozzle row is included.

Also, the present invention is not limited to the line head in the illustrated example and may be applied to a so-called shuttle-type liquid ejection head that performs drawing by intermittently transporting the recording medium P by a predetermined length corresponding to the length of the nozzle row and moving the liquid ejection head in a direction orthogonal to the nozzle row in synchronization with the intermittent transport.

Further, it does not matter whether the liquid ejection head according to the present invention is an ejection head that ejects only one kind of ink corresponding to monochrome image recording or a liquid ejection head that ejects multiple kinds of ink corresponding to color image recording.

As a preferable form, a region of the upper surface (droplet-ejection-side=recording-medium-P-side surface, hereinafter a droplet ejection direction (=recording medium P direction) will be referred to as an upward direction and the opposite direction will be referred to as a downward direction) of the ejection substrate 19 other than the ejection openings 24 is covered with a shield electrode 26 in its entirety.

The shield electrode 26 is a sheet-shaped electrode made of a conductive metallic plate or the like and common to every ejection opening 24 and is held at a predetermined potential (including 0 V through grounding). With the shield electrode 26, it becomes possible to stabilize the ejection of the ink droplets R by shielding electric lines of force of the ejection openings 24 (ejection portions) adjacent to each other and preventing electric field interferences between the ejection portions.

Also, as necessary, the surface of the shield electrode 26 may be subjected to ink repellency giving processing.

As a preferable form, 3-D barriers 28 are arranged on the upper surface of the shield electrode 26.

The 3-D barriers 28 are arranged to prevent the ink Q from mixing between the ejection openings 24, that is, separate the meniscuses of the ink Q at the ejection openings 24 (ejection portions) from each other with reliability by surrounding the ejection openings 24 and separating them from each other.

In the illustrated example, as shown in FIG. 2, the 3-D barriers 28 are formed as lattice walls that separate the ejection openings 24 from each other. However, the present invention is not limited to this and so long as it is possible to separate the ejection openings 24 from each other, other 3-D barriers may be used, an example of which is cylindrical 3-D barriers that each surround one ejection opening 24.

Also, in order to prevent the ink from climbing the wall surfaces of the 3-D barriers 28 with reliability and to separate the ejection openings 24 from each other with reliability, it is preferable that ink repellency is given to the surfaces of the 3-D barriers 28 through the ink repellency giving processing or the like. Note that it is sufficient that the ink repellency giving processing of the shield electrode 26 and the 3-D barriers 28 is performed with a known method corresponding to each forming material, a dispersion medium of the ink Q, and the like.

For the lower surface of the ejection substrate 19, ejection electrodes 30 are provided so as to respectively correspond to the ejection openings 24.

In the illustrated example, the ejection electrodes 30 are each a ring-shaped electrode surrounding one ejection opening 24 and are connected to the voltage application means 18.

It should be noted here that the ejection electrodes 30 are not limited to the ring shape in the illustrated example and may have a rectangular shape surrounding the ejection openings 24. Also, the ejection electrodes 30 are not limited to the shape surrounding the entire region of the ejection openings 24 and, for example, ejection electrodes in an approximately C-letter shape or the like may be used instead.

The voltage application means 18 is connected to the ejection electrodes 30. The voltage application means 18 is a means in which a drive voltage supply 50 and a bias voltage supply 52 are connected to each other in series, with a side (positive polarity side, for instance) having the same polarity as the charge potential of the colorant particles of the ink Q being connected to the ejection electrodes 30 and the other polarity side being grounded.

The drive voltage supply 50 is, for instance, a pulse voltage supply and supplies pulse-shaped drive voltages modulated in accordance with an image to be recorded (image data=ejection signal) to the ejection electrodes 30. The bias voltage,supply 52 constantly applies a predetermined bias voltage to the ejection electrodes 30 during image recording. With the bias voltage supply 52 (bias voltage application), it becomes possible to achieve a reduction in drive voltage, which makes it possible to achieve a reduction in power consumption and a cost reduction of the drive voltage supply.

Like the ejection substrate 19, the support substrate 20 is a substrate made of an insulative material such as glass.

The ejection substrate 19 and the support substrate 20 are arranged so as to be spaced apart from each other by a predetermined distance and a gap therebetween is set as an ink flow path 32 that supplies the ink Q to each ejection opening 24.

The ink flow path 32 is connected to the ink circulation system 16 to be described later and as a result of circulation of the ink Q through a predetermined path by the ink circulation system 16, the ink Q flows through the ink flow path 32 (from the right to left in the illustrated example, for instance) and is supplied to each ejection opening 24.

On the upper surface of the support substrate 20, the ink guides 22 are provided.

The ink guides 22 are each a member for facilitating the ejection of the ink droplet R by guiding the ink Q supplied from the ink flow path 32 to the ejection opening 24, stabilizing a meniscus through adjustment of the shape and size of the meniscus, and concentrating an electric field (electrostatic force) on the meniscus through concentration of the electric field on the ink guide 22 itself, and are respectively arranged for the ejection openings 24 so as to protrude from the surface of the ejection substrate 19 to the recording-medium-P (holding-means-14) side while passing through the ejection openings 24.

By each set of one ejection opening 24, one ejection electrode 30, and one ink guide 22 corresponding to each other, one ejection portion corresponding to one dot droplet ejection is formed.

The ink guides 22 are each a characteristic portion of the present invention and are made of a composite material obtained by dispersing fine particles of a high-dielectric material in a resin material.

As described above, the ink guides 22 are each required to be capable of appropriately stabilizing the meniscus of the ink Q at the ejection opening 24 by suitably guiding the ink Q (achieving excellent meniscus stability) and be capable of suitably concentrating the electrostatic force (achieving favorable electric field concentration force). In order to achieve the characteristics, it is important that each ink guide 22 is capable of being accurately formed into a fine shape, with which it is capable of guiding the ink with reliability and favorably, and has a sufficient dielectric constant with which it is capable of concentrating the electric field on itself favorably.

Under present circumstances, in order to obtain a favorable dielectric constant, the ink guides are made of a ceramic material. However, the ceramics is low in workability and formability and is also hard and fragile, so it is difficult to obtain ink guides achieving favorable meniscus stability by performing highly accurate forming. On the other hand, it is possible to obtain ink guides realizing favorable meniscus stability by performing highly accurate forming from a resin material, although the resin-made ink guides have an extremely low dielectric constant and therefore are incapable of achieving favorable electric field concentration force.

Also, a method is conceivable which copes with both of the molding accuracy and the electric field concentration force by molding the ink guides from a resin and forming electrodes (ejection electrodes or auxiliary electrodes) on surfaces thereof. With this method, however, the productivity of the ink guides, that is, the productivity of the ejection head is lowered. Also, electric field interferences between the ejection portions are easy to occur, so it becomes difficult to increase the density of the ejection portions and realize the two-dimensional arrangement of the ejection portions in the illustrated example.

In order to solve the problems, the ejection head 12 according to the present invention includes the ink guides 22 made of a composite material (composite resin) obtained by dispersing fine particles of a high-dielectric material in a resin material.

The dielectric constant of the ceramic material, such as $ZrO_2$(zirconia) or $Al_2O_3$ (alumina), used for the molding of the ink guides is around 20. Also, the dielectric constant of an epoxy resin is around 4. In contrast to this, for instance, the dielectric constant of a composite material obtained by dispersing fine particles (0.8 μm) of PMN-PT (whose dielectric constant is 17800) in the epoxy resin at a ratio of 40% (volume percentage) is around 30 that is same level or higher than the dielectric constant of the ceramic material (see Journal of the Adhesion Society of Japan, Vol. 39, No. 2 (2003)).

Therefore, in the case of the ink guides 22 made of such a composite material, both of fine formability and workability brought by the main ingredient (matrix) being a resin material and a high dielectric constant are coped with and excellent meniscus stability and electric field concentration force are achieved. With the ejection head 12 according to the present invention including the ink guides 22, it becomes possible to set meniscuses under a stabilized and appropriate state and suitably concentrate electric fields (electrostatic forces) on the ink guides, so it becomes possible to eject the ink droplets for flying through low-voltage drive, at high speed (high recording (droplet ejection) frequency), with stability.

Also, the ink guides 22 include no electrode, so it becomes possible to arrange the ejection portions at a high density in response to high-resolution recording and it also becomes possible to achieve an increase in resolution, an increase in the number of channels, and the two dimensional ejection portion arrangement in the illustrated example with ease.

In the ejection head 12 according to the present invention, no specific limitation is imposed on the composite material of the ink guides 22 and it is possible to use various composite materials that are each obtained by dispersing a high-dielectric material in a resin material having sufficient resistance with respect to the ink Q.

For instance, it is possible to use composite materials obtained by dispersing fine particles of high-dielectric materials, such as PZT (lead zirconate titanate: $Pb(Zr,Ti)O_3$), PMN-PT (lead magnesium niobate-lead titanate: $Pb(Mg_{1/3}Nb_{2/3})O_3$-$PbTiO_3$), barium titanate ($BaTiO_3$), and strontium titanate ($SrTiO_3$), in resin materials such as a silicon resin, a raw rubber, an epoxy resin, an urethane resin, a polyimide resin, and a phenol resin. Preferably, a high-dielectric material, whose dielectric constant is 100 or more, is used.

More specifically, it is possible to use a composite material obtained by dispersing fine particles of PMN-PT in the epoxy resin, a composite material obtained by dispersing fine particles of PZT in the epoxy resin, a composite material obtained by dispersing fine particles of PMN-PT in the urethane resin, and the like.

The dielectric constant, formability, and the like of a composite material of a resin material and a high-dielectric material depend on the particle size, particle shape, and filling density (content of the high-dielectric material in the composite material) of the high-dielectric material, interaction between particles of the high-dielectric material, and the like and the characteristics of the composite material vary in accordance with a combination thereof.

Accordingly, an amount ratio between the resin material and the high-dielectric material of the composite material used to form the ink guides 22 is not specifically limited and it is sufficient that an amount ratio, with which it is possible to realize a dielectric constant that is 20 or more that is equal to or more than the dielectric constant of the ceramics material, is determined as appropriate in accordance with the formability, strength, and the like of the ink guides 22, the dielectric constant of the high-dielectric material, and the like.

Here, a construction in which the amount ratio of the high-dielectric material is increased is advantageous in terms of the dielectric constant but is disadvantageous in terms of the formability and strength. When consideration is given to a balance therebetween, it is preferable that a weight ratio of the high-dielectric material in the composite material made of a resin material and a high-dielectric material is 10 to 80%.

Also, the particle diameter of the high-dielectric material in the composite material is not specifically limited.

In order to perform fine working with high accuracy, a small particle diameter is advantageous and in order to obtain sufficient formability of the ink guides 22, it is preferable that the particle diameter of the high-dielectric material is 10 μm or less. However, ordinarily, as the particle diameter is reduced, the cost is increased, so the particle diameter of the high-dielectric material is determined as appropriate and is preferably set at 10 μm or less with consideration given to a balance between the formability and the cost.

In the ejection head 12 in the illustrated example, the ink guides 22 each have a shape including a lower (base-portion-side) cylindrical portion and an upper (tip-end-portion-side) conical portion, although the ink guides in the present invention are not limited to the shape in the illustrated example and various shapes are usable.

For instance, a conical shape may be used which does not include the lower cylindrical portion in the illustrated example, a pyramidal shape such as a quadrilateral pyramidal shape or a hexagonal pyramidal shape may be used, and a shape may be used which includes a lower prismatic portion and an upper pyramidal portion. Also, like the ink guide disclosed in JP 10-230608 A, a shape may be used which includes a notched portion, a groove, or the like that guides the ink to the tip end portion or the like.

Further; the ink guides are not limited to the shapes described above that are gradually narrowed toward the tip end portion and may have a shape, such as a columnar shape or a prismatic shape, whose thickness is uniform.

However, when consideration is given to electric field concentration at the tip end portion of the ink guide, that is, the meniscus tip end portion, a shape is preferable in which at least the upper portion is gradually narrowed toward the tip end and a shape, such as a conical shape or a pyramidal shape, whose tip end portion is sharply pointed is particularly preferable. Also, by narrowing the tip end portion of the ink guide, it also becomes possible to improve ejectability and reduce the size of the ink droplet R by narrowing the meniscus.

In the illustrated example, in the ejection head 12 according to the present invention, each ink guide 22 is made of the composite material in its entirety, although only the tip end portion may be made of the composite material and a remaining portion may be made of a resin material having excellent formability.

It should be noted here that when only the tip end portion is made of the composite material, it is preferable that at least a portion on an ink ejection direction side (that is, a recording medium P side) with respect to the ejection electrode 30 is made of the composite material. With this construction, even when the ink guide is not made of the composite material in its entirety, it becomes possible to achieve sufficient electric field concentration force.

It is possible to form the ink guide 22 with various methods. A preferred example of which will be described with reference to FIG. 3.

Figure 3A:
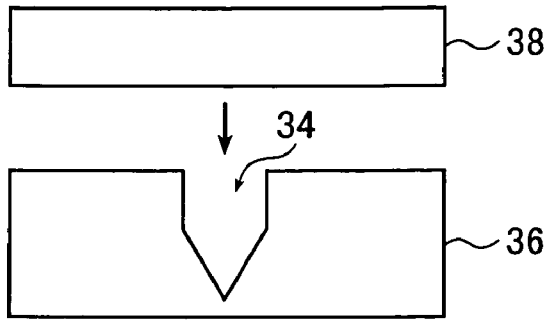
FIGS. 3A to 3E are each a conceptual diagram illustrating an example of the solution guide manufacturing method according to the present invention.

As shown in FIG. 3A, a mold 36 including a concave portion 34 corresponding to the shape and arrangement of the ink guide 22 and a composite material 38 obtained by dispersing fine particles of a high-dielectric material in a resin material are prepared. The mold 36 is produced by forming the concave portion 34 corresponding to the shape of the ink guide 22 in an Si substrate through anisotropic etching, for instance.

Figure 3B:
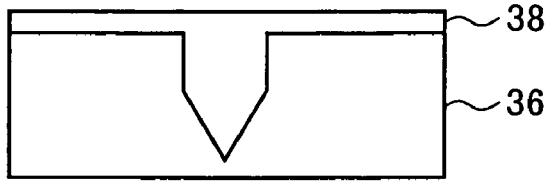
Figure 3C:
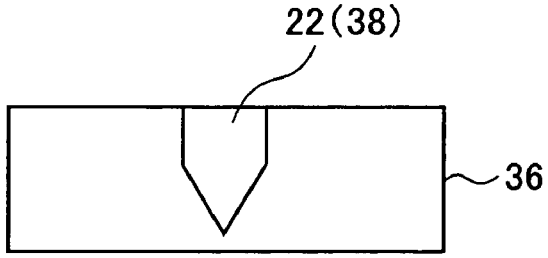

Then, as shown in FIG. 3B, the composite material 38 is filled into the mold 36 (concave portion 34), and is hardened by performing heat curing at a temperature corresponding to the composite material as necessary. Following this, as shown in FIG. 3C, redundant composite material 38 other than the ink guide 22 is removed through etching or the like. Note that, like in the case of an ordinary resin material, it is possible to perform the heat curing of the composite material at around 200° C. that is a markedly low temperature as compared with the case of a ceramic material.

Figure 3D:
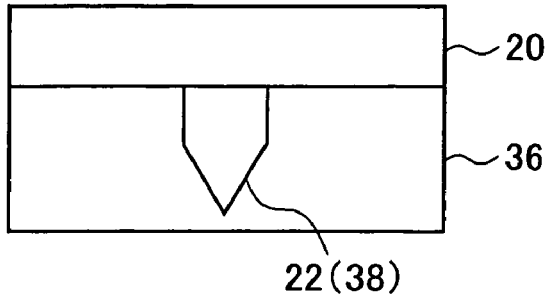
Figure 3E:
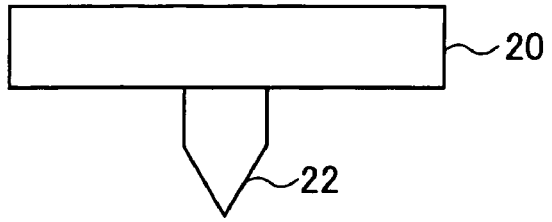
Figure 4:
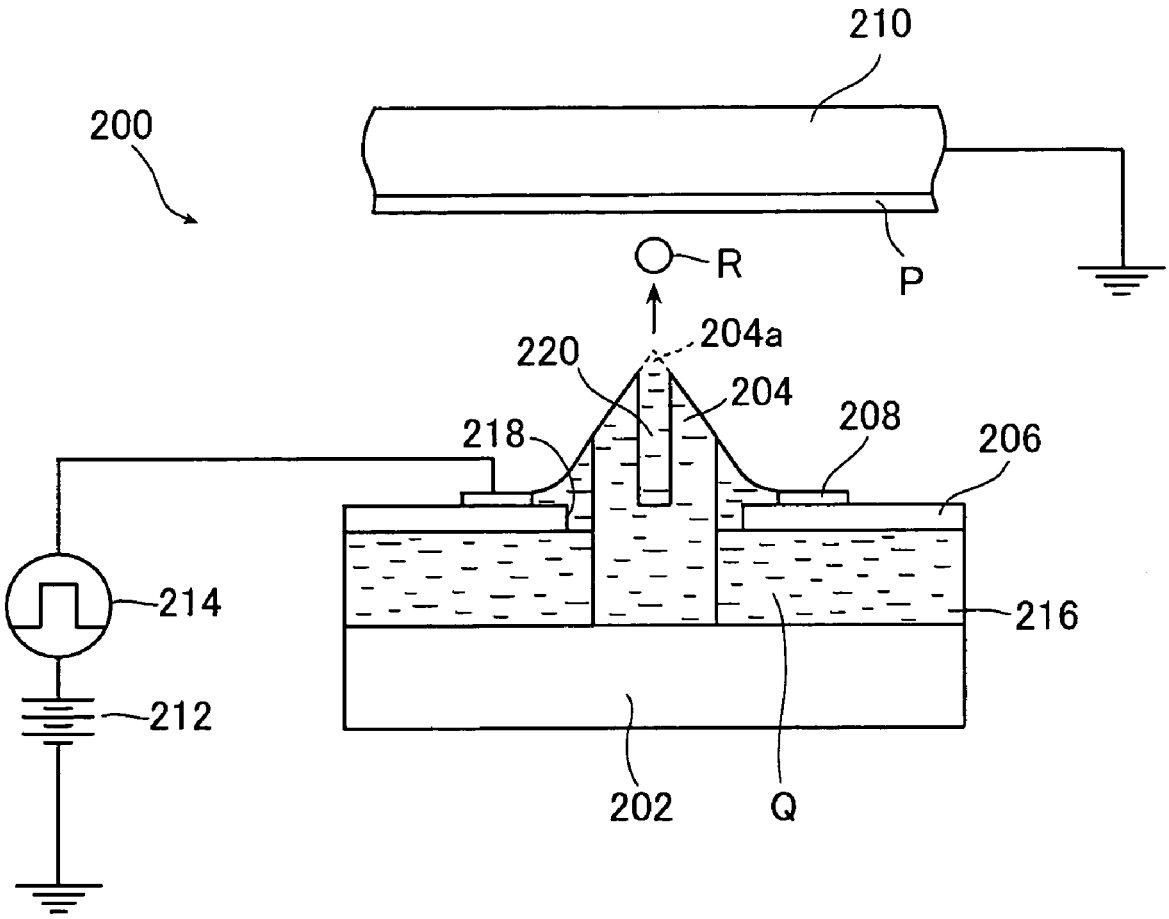
FIG. 4 PRIOR ART
FIG. 4 is a conceptual diagram illustrating an example of a conventional liquid ejection head.

Next, the ink guide 22 (support substrate 20 on whose upper surface the ink guide 22 has been formed) is obtained through bonding of the support substrate 20 shown in FIG. 3D and removal of the mold 36 through etching or the like shown in FIG. 3E.

With this manufacturing method, it becomes possible to use the composite material only for the ink guide 22 and form the support substrate 20 using a low-dielectric material, which makes it possible to avoid a time delay of a signal in a wiring portion due to a high dielectric constant.

In addition, it also becomes possible to achieve an increase in resolution, an increase in the number of channels, and the two dimensional ejection portion arrangement like the illustrated example with ease.

As described above, the ink is supplied by the ink circulation system 16 to the ink flow path 32 formed between the ejection substrate 19 and the support substrate 20.

The ink circulation system 16 includes an ink supply means 54 having an ink tank reserving the ink Q and a pump supplying the ink Q, an ink supply flow path 56 that connects the ink supply means 54 and an ink inflow opening of the ink flow path 32 (right-side end portion of the ink flow path 32 in FIG. 1) to each other, and an ink recovery flow path 58 that connects an ink outflow opening of the ink flow path 32 (left-side end portion of the ink flow path 32 in FIG. 1) and the ink supply means 54 to each other. Also, in addition to those construction elements, the ink circulation system 16 may include a means for replenishing the ink tank with ink and the like.

The ink Q is circulated through a path in which the ink Q is supplied from the ink supply means 54 to the ink flow path 32 of the ejection head 12 through the ink supply flow path 56, flows through the ink flow path 32 (flows from the right to the left in the drawing), and returns from the ink flow path 32 to the ink supply means 54 through the ink recovery flow path 58. During the ink circulation, the ink is supplied from the ink flow path 32 to each ejection openings 24.

It should be note here that, as the ink Q that the ejection head 12 according to the present invention ejects, it is possible to use various kinds of ink Q (solutions), such as ink Q obtained by dispersing charged particles containing colorants in a dispersion medium, which are obtained by dispersing charged fine particles in dispersion media and are applied to electrostatic ink jet printer.

As described above, the holding means 14 holds the recording medium P and scan-transports it in a direction (hereinafter referred to as the "scanning direction") orthogonal to the nozzle row direction of the ejection head 12.

In the illustrated example, the holding means 14 includes a counter electrode 70 that also functions as a platen holding the recording medium P under a state in which the medium P faces the upper surface of the ejection head 12 (ejection substrate 19), a counter bias voltage supply 72, and a scan-transport means (not shown) for scan-transporting the recording medium P in the scanning direction by moving the counter electrode 70 in the scanning direction. As a result of the scan-transport, the recording medium P is two-dimensionally scanned in its entirety by the ejection openings 24 (nozzle row) of the ejection head 12 and an image is recorded by the ink droplets R modulated and ejected from the respective ejection openings 24.

No specific limitation is imposed on the recording medium P holding means achieved by the counter electrode 70 and it is sufficient to use various known methods such as a method utilizing an electrostatic force, a method using a jig, and a method based on suction.

Also, no specific limitation is imposed on a method of moving the counter electrode 70 and it is sufficient that a known plate-shaped member moving method is used. Note that, in the recording apparatus using the ejection head 12 according to the present invention, the recording medium P may be scanned by the nozzle row by fixing the recording medium P and moving (scanning) the ejection head 12.

The counter bias voltage supply 72 applies a bias voltage having a polarity opposite to that of the ejection electrode 30 (=colorant particles) to the counter electrode 70. Note that the other polarity side of the bias voltage supply 72 is grounded.

Hereinafter, an image recording operation of the recording apparatus 10 will be described.

At the time of image recording, the ink Q is circulated by the ink circulation system 16 through the path from the ink supply means 54 through the ink supply flow path 56, the ink flow path 32 of the ejection head 12, and the ink recovery flow path 58 to the ink supply means 54. As a result of the circulation, the ink Q flows into the ink flow path 32 (ink flow of 200 mm/s, for instance) and is supplied to each ejection opening 24.

Also, at the time of the image recording, the bias voltage supply 52 applies a bias voltage of 100 V to the ejection electrodes 30. Further, the recording medium P is held by the counter electrode 70 and the counter bias voltage supply 72 applies a bias voltage of −1000 V to the counter electrode 70. Consequently, between the ejection electrodes 30 and the counter electrode 70 (recording medium P), a bias voltage of 1100 V is applied and an electric field (electrostatic force) corresponding to the bias voltage is formed.

As a result of the circulation of the ink Q, the electrostatic force resulting from the bias voltage, the surface tension of the ink Q, the capillary phenomenon, the action of the ink guides 22, and the like, meniscuses of the ink Q are formed at the ejection openings 24. Then, the colorant particles (positively charged in this example) migrate to the ejection openings 24 (meniscuses) and the ink Q is concentrated. As a result of the concentration, the meniscuses further grow. Finally, a balance is struck between the surface tension of the ink Q and the electrostatic force or the like and the meniscuses are stabilized.

Under this state, when the drive voltage supply 50 applies a drive voltage of 200 V, for example, to the ejection electrodes 30, the electrostatic force acting on the ink Q and the meniscuses is increased, concentration of the ink Q at the meniscuses is promoted, and the meniscuses sharply grow. Following this, at a point in time when the growing force of the meniscuses, the moving force of the colorant particles to the meniscuses, and the attraction force from the counter electrode 70 exceed the surface tension of the ink Q, the ink droplets R of the ink Q in which the colorant particles have been concentrated ate ejected.

The ejected ink droplets R fly due to momentum at the time of the ejection and the attraction force from the counter electrode 70, impinge on the recording medium P, and form an image.

As described above, at the time of the image recording, the recording medium P is scan-transported in the scanning direction orthogonal to the nozzle row under a state in which the recording medium P faces the ejection head 12.

Consequently, by performing modulation and applying a drive voltage to each ejection electrode 30 (driving the ejection electrode 30) in accordance with image data (ink droplet R ejection signal) in synchronization with the scan-transport, it becomes possible to modulate and eject the ink droplets R in accordance with an image to be recorded and perform image recording in an on-demand manner onto the entire surface of the recording medium P.

Here, the ejection head 12 according to the present invention includes the ink guides 22 made of a composite material containing a resin material and fine particles of a high-dielectric material dispersed in the resin material, so favorable meniscus stability is achieved as a result of high forming accuracy and electrostatic forces are favorably exerted on the meniscuses as a result of the high electric field concentration force of the ink guides. Consequently, it becomes possible to perform high-speed and stabilized ejection of the ink droplets R even at a low drive voltage (and a low bias voltage in some cases), thereby performing recording of high-quality images with low power consumption and with stability.

It should be noted here that the liquid ejection head according to the present invention is not limited to the ink jet head that ejects ink containing charged colorant particles and may be applied to various kinds of liquid ejection heads that each ejects a solution containing charged particles. For example, the liquid ejection head according to the present invention may be used in a coating apparatus that coats an object with a solution containing charged particles of a high-temperature-resistant resin such as a polyimide resin by ejecting droplets of the solution through the use of the action of the charged particles.

The liquid ejection head and the solution guide manufacturing method according to the present invention have been described in detail above. However, the present invention is not limited to the embodiment described above and it is of course possible to make various changes and modifications without departing from the gist of the present invention.

What is claimed is:

1. A liquid ejection head that ejects droplets of a solution in which charged particles are dispersed by exerting electrostatic forces on the solution, comprising:

an insulative ejection substrate in which a plurality of through holes for the droplet ejection are formed;

ejection electrodes that are each arranged in correspondence with each of said through holes and exert the electrostatic forces on the solution; and solution guides that pass through said through holes and protrude toward a droplet ejection side of said ejection substrate, wherein said solution guides are each a member whose at least tip end portion is made of a composite material containing a resin material and particles of a high-dielectric material dispersed in the resin material.

2. The liquid ejection head according to claim 1, wherein said solution guides each have a shape that is gradually narrowed toward a tip end.

3. The liquid ejection head according to claim 1, wherein said solution guides are each a member whose at least tip end side with respect to a corresponding ejection electrode is made of said composite material.

4. The liquid ejection head according to claim 1, wherein the resin material is any one of a silicon resin, an epoxy resin, an urethane resin, a polyimide resin, and a phenol resin, and the high-dielectric material is any one of PZT, PMN—PT, barium titanate, and strontium titanate.

* * * * *